US005247604A

United States Patent [19]

Chiu

[11] Patent Number: 5,247,604

[45] Date of Patent: Sep. 21, 1993

[54] HUMIDIFIER TANK WITH LEAKAGE CONTROL CAP

[75] Inventor: Bernard Chiu, Ashland, Mass.

[73] Assignee: Duracraft Corporation, Whitinsville, Mass.

[21] Appl. No.: 870,839

[22] Filed: Apr. 20, 1992

[51] Int. Cl.[5] ..... B05B 1/24

[52] U.S. Cl. ..... 392/406; 239/135; 261/142; 261/DIG. 65; 392/337

[58] Field of Search ..... 392/405, 406, 403, 394, 392/336, 337; 261/DIG. 65, 142; 239/135, 136

[56] References Cited

U.S. PATENT DOCUMENTS

| | | | |
|---|---|---|---|
| 1,292,759 | 1/1919 | Granger | 392/403 |
| 2,443,417 | 6/1948 | Duncan | 392/405 |
| 2,847,546 | 8/1958 | Crowley | 392/406 |
| 3,085,145 | 4/1963 | Wray | 392/406 |
| 4,906,417 | 3/1990 | Gentry | 392/405 |

FOREIGN PATENT DOCUMENTS

| | | | |
|---|---|---|---|
| 55-92895 | 7/1980 | Japan | 392/406 |

*Primary Examiner*—Anthony Bartis

*Attorney, Agent, or Firm*—John E. Toupal; Harold G. Jarcho

[57] ABSTRACT

A humidifier including a base defining a liquid reservoir; a humidification mechanism for dispensing liquid contained in the reservoir; and a tank removably mounted on the base and having a bottom wall including a tube projecting into the reservoir and with a lower lip defining a fill opening, and a liquid discharge opening for providing a controlled discharge of liquid so as to maintain a given level of liquid in the reservoir. Also included is a cap engaged with the tube and having a cover portion closing the fill opening, and an annular gripping portion extending outwardly from the cover portion by the lip and upwardly adjacent to an outer wall of the tube so as to define therewith an annular cavity, and wherein the gripping portion defines control means providing liquid communication between a lower portion of the annular cavity and the reservoir. The gripping portion facilitates removal and installation of the cap while the control means prevents over filling of the reservoir in the event of inadvertent leakage between the cap and tube.

9 Claims, 3 Drawing Sheets

HUMIDIFIER TANK WITH LEAKAGE CONTROL CAP

BACKGROUND OF THE INVENTION

This invention relates generally to a humidifier and, more particularly, to a humidifier with a liquid tank having a leakage control cap.

Many present day humidifiers employ bases that define a liquid filled reservoir in which water is heated to evaporation temperature by a suitable heating unit. Water is usually supplied to the reservoir by a tank removably supported by the base. Typically, the supply tank includes a bottom wall that defines a fill opening and a discharge spout that projects downwardly into the liquid reservoir in the base. During use, the supply tank is filled with water through the fill opening which is then closed by a removable cap. The filled tank is then inverted and positioned on the base after which water is supplied to the base reservoir through the discharge spout. The level of water maintained in the base reservoir is determined by the projection thereinto of the discharge spout and existing fluid dynamics of the system including weight of water in the tank, surface tension of water, vacuum pressure produced in the tank, atmospheric pressure above the liquid in the base reservoir, etc. When the water level in the reservoir drops below a predetermined desired level a pressure imbalance evolves across the discharge spout allowing air to enter the tank and a resultant water discharge therefrom to again create a pressure equalization and the desired water level. However, inadvertent water leakage through the removable cap in the fill opening will produce an undesirable increase in water level that can result in water spillage and inefficient humidifier operation. Another problem of prior humidifiers is an inability to provide a tangible indication of proper operation.

The object of this invention, therefore, is to provide an improved humidifier that alleviates problems associated with tank leakage and provides a tangible indication of proper operation.

SUMMARY OF THE INVENTION

The invention is a humidifier including a base defining a liquid reservoir; a humidification mechanism for dispensing liquid contained in the reservoir; and a tank removably mounted on the base and having a bottom wall including a tube projecting into the reservoir and with a lower lip defining a fill opening, and a liquid discharge opening for providing a controlled discharge of liquid so as to maintain a given level of liquid in the reservoir. Also included is a cap engaged with the tube and having a cover portion closing the fill opening, and an annular gripping portion extending outwardly from the cover portion by the lip and upwardly adjacent to an outer wall of the tube so as to define therewith an annular cavity, and wherein the gripping portion defines control means providing liquid communication between a lower portion of the annular cavity and the reservoir. The gripping portion facilitates removal and installation of the cap while the control means prevents overfilling of the reservoir in the event of inadvertent leakage between the cap and tube.

According to one feature of the invention, the control means comprises at least one control opening in the gripping portion. The control opening establishes a liquid flow path that produces a water seal of the tube in the event of leakage.

According to another feature of the invention, the control opening is substantially transversely aligned with the lower lip. This feature produces a liquid seal at substantially the level of the lower lip.

According to another feature of the invention, the lower lip is substantially aligned with the given level. This feature insures maintenance of the desired reservoir liquid level in the event of inadvertent leakage.

According to yet another feature of the invention, the gripping portion has a textured outer surface.

According to further features of the invention, the tube defines an inner surface with interlock means, the cover portion defines an outer surface with interlock means engaged with the interlock means on the inner surface, the outer surface and the gripping portion are joined by an annular connecting portion extending over the lower lip, and an annular seal is disposed between the connecting portion and the lower lip. This configuration facilitates creation of a liquid seal between the cap and the tube.

Also encompassed by the invention is a humidifier including a base defining a liquid reservoir; a humidification mechanism for heating liquid contained in the reservoir and defining a fluid flow path for receiving liquid vapor therefrom; and a nozzle disposed to discharge liquid vapor received from the fluid flow path, the nozzle defining an elongated vapor passage communicating with the flow path and terminating with a discharge aperture and an elongated open well including an elongated wall portion partially defining the vapor passage. The open well can be filled with medication that is warmed by hot vapor in the vapor passage.

According to one feature of this invention, the elongated wall portion constitutes at least thirty percent of the wall surface forming the well. The significant common wall portion enhances heat transfer between the well and vapor passage.

According to other features of the invention, the humidification mechanism has an upper wall supporting the nozzle, and the nozzle includes a projection portion defining the aperture and projecting substantially above the upper wall and defining a channel having an open side. The upwardly projecting nozzle with an open side facilitates monitoring of proper humidifier operation.

According to still another feature of this invention, the nozzle is an integrally molded unit removably mounted on the upper wall. The integrally molded nozzle is low cost and can be conveniently removed for cleaning.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
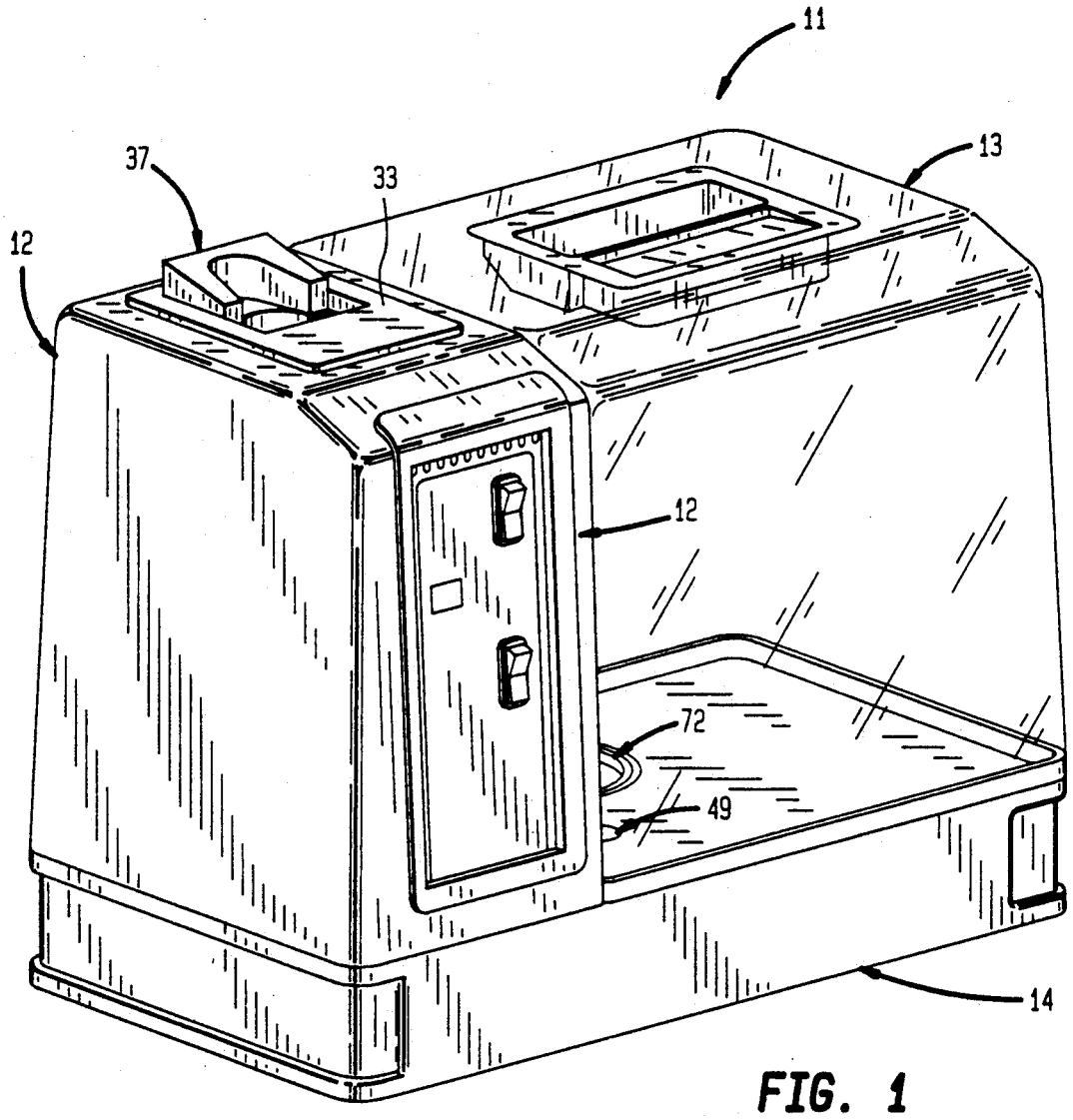
FIG. 1 is a perspective view of a humidifier in accordance with the invention.

A humidifier 11 includes an humidification unit 12 and a liquid supply tank 13 each removably mounted side by side on a base 14. A peripheral rim portion 15 projects upwardly from an upper surface 17 of the base 14 and defines an enclosure for removably receiving the evaporation unit 12 and the supply tank 13 juxtaposed thereto. Formed in the base 14 and below the base surface 17 is a reservoir 20 that includes a boiler cavity 22. Also included in the reservoir 20 is a liquid supply channel 23 having a outlet end 24 communicating with the boiler cavity 22 and an inlet end 25 located below the supply tank 13. A valve actuator stem 26 projects upwardly from a bottom of the liquid supply channel 23 adjacent to the inlet end 25.

Figure 4:
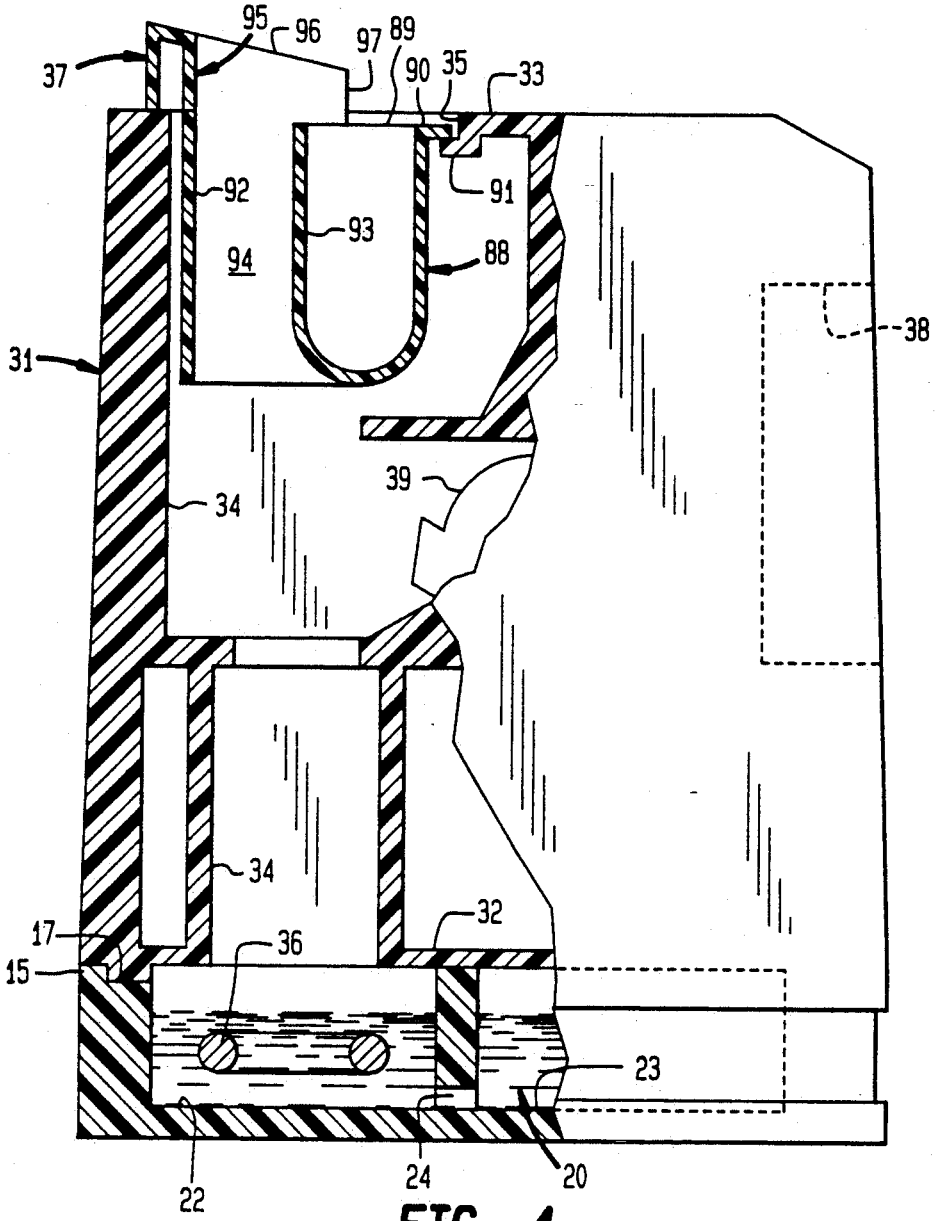
FIG. 4 is a view partially in cross section of the humidifier shown in FIG. 1.

As shown in FIGS. 1 and 4, the humidification unit 12 includes an enclosure 31 having a bottom wall 32 and an upper wall 33. The enclosure 31 defines a vapor air flow path 34 providing communication between the boiler cavity 22 and an outlet 35. Supported by the bottom wall 32 and extending downwardly therefrom is a heater coil 36 that projects into the boiler cavity 22 in the base 14. A nozzle 37 is supported by the upper wall 33 in the outlet 35. Retained by the enclosure 32 adjacent to the vapor passage 34 is electrical control circuitry 38. Also retained by the enclosure 32 is an air blower 39 with an outlet disposed to discharge air into vapor passage 34.

Figure 2:
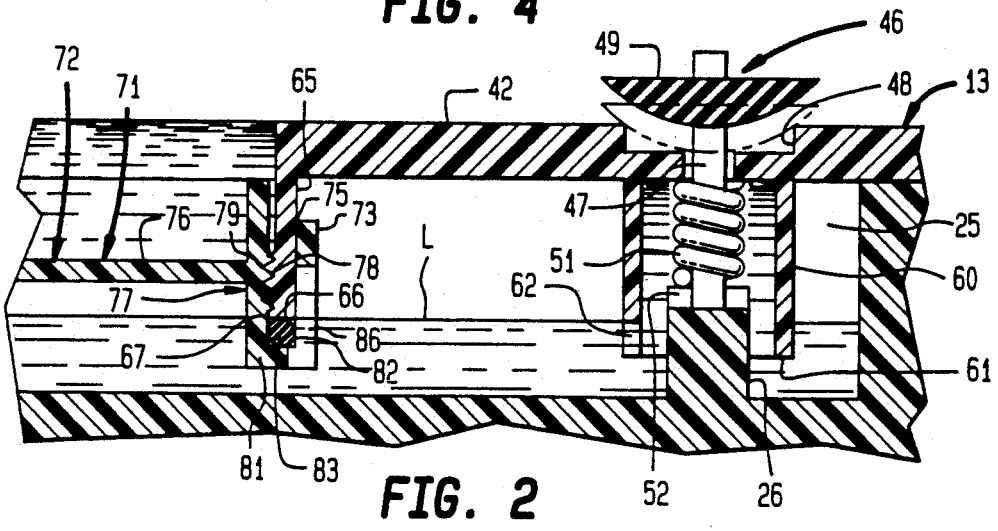
FIG. 2 is a fragmentary cross sectional view illustrating internal components of the humidifier shown in FIG. 1.

As shown in FIG. 2, the liquid supply tank 13 includes a bottom wall 42 retained within the rim portion 15 of the base 14 and an upper vessel portion 43 for storing a supply of liquid such as water. A valve assembly 46 is retained by the bottom wall 42 of the tank 13. Forming the valve assembly 46 is a valve stem 47 extending through a liquid discharge opening 48 in the bottom wall 42 and a valve 49. A spring 51 extending between the bottom wall 42 and a bracket 52 mounted on an end of the stem 47 normally biases the valve 49 into a seated position closing the discharge opening 48 as shown by dashed lines in FIG. 2. Projecting downwardly from the bottom wall 42 and enclosing a lower portion of the valve assembly 46 is a skirt 60 having an open bottom end 61 intersected by slots 62. With the tank 13 properly positioned on the base 14, engagement of the bracket 52 on the valve stem 47 with the actuator stem 26 in the base 14 moves the valve 49 into an open position shown by solid lines in FIG. 2. Accordingly, a controlled discharge of water flows from the tank 13 through the opened valve 49 and into the reservoir 20. As long as a supply of water exists in the sealed tank 13, a given water level L determined by the height of the slots 62 in the skirt 60 will be retained within the reservoir 20 by the opened valve 49.

Figure 3:
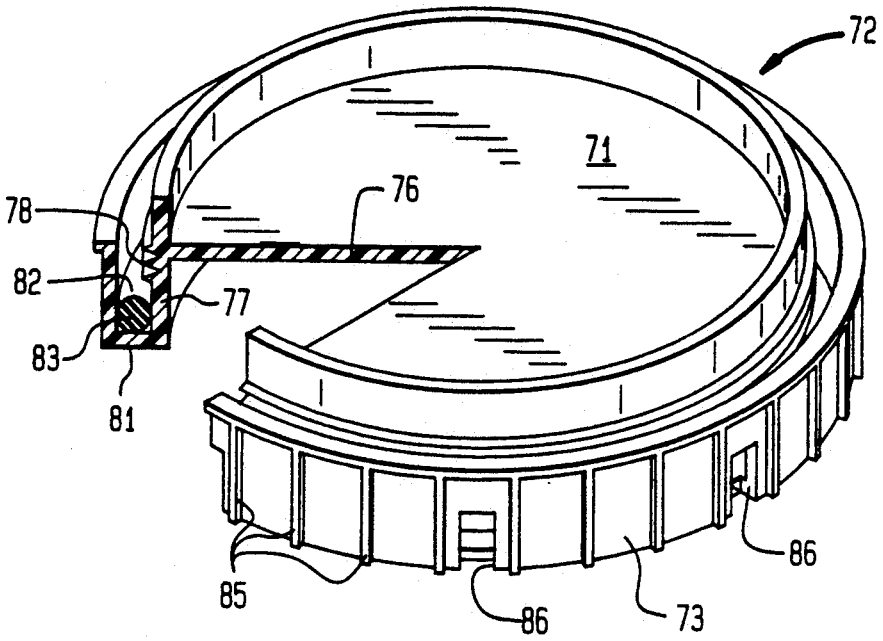
FIG. 3 is an exploded perspective view of a tank cap shown in FIG. 2.

As also shown in FIG. 2, the bottom wall 42 of the tank 13 defines a tube 65 that projects downwardly into the reservoir 20. A lower lip 66 of the tube 65 defines a fill opening 67 for the upper vessel 43. Closing the fill opening 67 is a cover portion 71 of a cap 72 illustrated in FIG. 3. As shown in FIG. 2, the cap 72 also has an annular gripping portion 73 disposed adjacent to an outer surface of the tube 45 and forming therewith an annular cavity 75. The cover portion 71 includes a circular lid portion 76 and a downwardly projecting skirt portion 77 having an outer wall 78 with interlocking threads. Engaging the interlocking threads 78 on the cap 72 are interlocking threads on an inner wall surface 79 of the tube 65. Joining the gripping and skirt portions 73, 77, respectively, of the cap 72 is an annular connecting portion 81 that defines therewith an annular recess 82. An O-ring seal 83 disposed in the recess 82 provides a liquid seal between the connecting portion 81 and the lower lip 66 of the tube 45. Circumferentially spaced apart vertical ribs 85 provide the gripping portion 73 with a textured outer surface that increases friction to facilitate tightening of the cap 72 on the tube 45.

Formed in the lower portion of the gripping portion 73 are a plurality of circumferentially spaced apart liquid level control slots 86 establishing fluid flow openings between the annular cavity 75 and the reservoir 20. In the event of a defective seal between the cap 72 and the tube 45, liquid leakage out of the fill opening 67 will pass through the slots 86 into the reservoir 20. However, when the liquid level in the reservoir 20 reaches the level of the lower lip 66, the fill opening 67 will be sealed by water in the reservoir 22 to prevent further leakage flow between the cap 72 and tube 45. Thus, leakage out of the opening 67 will not cause water in the reservoir 20 to reach a level defined by the upper edge of the gripping portion 72 as would be the case in the absence of the control slots 86. Preferably, the slots 86 are substantially transversely aligned with the lower lip 66 of the tube and with the given liquid operating level L desired for the humidifier 11. In that case, the desired operating level L will be maintained in the reservoir 20 even in the presence of inadvertent leakage between the cap 72 and the tube 45.

The nozzle 37 preferably is an integrally molded unit and is removably supported on the upper wall 33 of the humidification unit 12. Included in the nozzle 37 is an elongated cylindrical well 88 with an open top 89 for receiving medication. Projecting outwardly from an upper portion of the well 88 is a flange 90 that is supported by a shoulder portion 91 on the upper wall 33 of the humidification unit 12. Also included in the nozzle 37 is a sidewall 92 having ends that intersect and are coextensive with substantially diametrically opposed full length portions of the well 88. An elongated wall surface 93 of the well 88 and the side wall 92 form a channel 94 that provides communication between the flow path 34 in the humidification unit 12 and the surrounding environment. Preferably, the configuration of the nozzle 37 is such that the combined wall portion 93 of the well 88 composes at least thirty percent of the total wall surface of the well 88 so as to establish a significant heat transfer between the well 88 and the channel 94.

Figure 5:
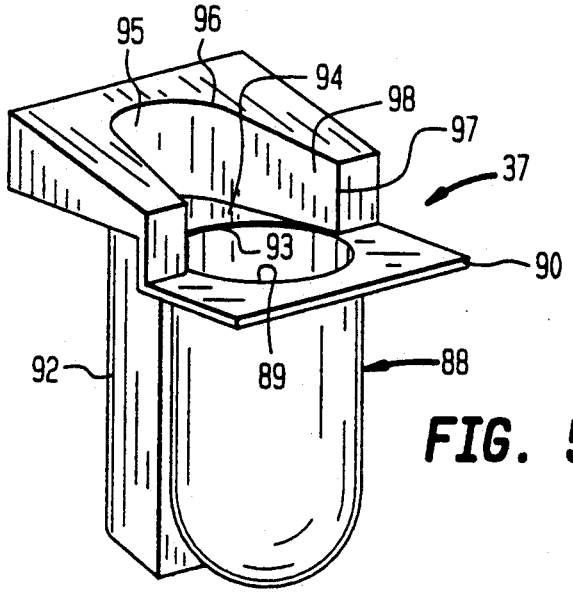
FIG. 5 is an exploded perspective view of a nozzle shown in FIGS. 1 and 4.

As shown in FIG. 5, the side wall 92 includes a projection portion 95 that extends above the upper wall 33 of the humidification unit 12 and the top of the cylindrical well 88. An upper edge of the projection portion 95 defines a discharge aperture 96 for vapor generated in the humidification unit 12. The projection wall portion 95 terminates with exposed edges 97 providing a transverse opening 98 into that portion of the channel 94 above the upper wall 33 of the humidification unit 12. Because of the transverse opening 98 into the upwardly projecting channel portion 95, a user is provided with visible evidence of vapor escaping from the humidification unit 12 thereby verifying its operability and the presence of water in the reservoir 20.

Obviously, many modifications and variations of the present invention are possible in light of the above teachings. It is to be understood, therefore, that the invention can be practiced otherwise than as specifically described.

What is claimed is:

1. A humidifier comprising:

base means defining a liquid reservoir;

humidification means for dispensing liquid contained in said reservoir;

a tank removably mounted on said base means and having a liquid discharge opening for providing a controlled discharge of liquid from said tank to said reservoir so as to maintain a given level of liquid therein; said tank having a bottom wall including a tube projecting into said reservoir and with a lower lip defining a fill opening; and a cap engaged with said tube and having a cover portion closing said fill opening, and an annular gripping portion extending outwardly from said cover portion by said lip and upwardly adjacent to an outer wall of said tube so as to define therewith an annular cavity, and wherein said gripping portion defines control means providing liquid communication between a lower portion of said annular cavity and said reservoir.

2. A humidifier according to claim 1 wherein said control means comprises at least one control opening in said gripping portion.

3. A humidifier according to claim 2 wherein said control opening is substantially transversely aligned with said lower lip.

4. A humidifier according to claim 3 wherein said lower lip is substantially aligned with said given level.

5. A humidifier according to claim 4 wherein said gripping portion has a textured outer surface to improve gripping friction.

6. A humidifier according to claim 5 wherein said tube defines an inner surface with interlock means, and said cover portion defines an outer surface with interlock means engaged with said interlock means on said inner surface.

7. A humidifier according to claim 6 wherein said outer surface and said gripping portion straddle said tube.

8. A humidifier according to claim 7 wherein said outer surface and said gripping portion are joined by an annular connecting portion extending over said lower lip.

9. A humidifier according to claim 8 including an annular seal disposed between said connecting portion and said lower lip.

* * * * *